US009464541B2

(12) United States Patent
Haga

(10) Patent No.: US 9,464,541 B2
(45) Date of Patent: Oct. 11, 2016

(54) CONTROL DEVICE OF INTERNAL COMBUSTION ENGINE AND VARIABLE VALVE DEVICE OF INTERNAL COMBUSTION ENGINE

(71) Applicant: TOYOTA JIDOSHA KABUSHIKI KAISHA, Toyota-shi, Aichi-ken (JP)

(72) Inventor: Hiroyuki Haga, Numazu (JP)

(73) Assignee: TOYOTA JIDOSHA KABUSHIKI KAISHA, Toyota-Shi (JP)

( * ) Notice: Subject to any disclaimer, the term of this patent is extended or adjusted under 35 U.S.C. 154(b) by 0 days.

(21) Appl. No.: 14/709,983

(22) Filed: May 12, 2015

(65) Prior Publication Data

US 2015/0330265 A1 Nov. 19, 2015

(30) Foreign Application Priority Data

May 14, 2014 (JP) ..... 2014-100531

(51) Int. Cl.

| | |
|---|---|
| ***F01L 1/24*** | (2006.01) |
| ***F01L 1/18*** | (2006.01) |
| ***F01L 1/34*** | (2006.01) |
| ***F01L 1/46*** | (2006.01) |
| ***F01L 1/26*** | (2006.01) |
| *F01L 13/00* | (2006.01) |

(52) U.S. Cl.

CPC ..... *F01L 1/185* (2013.01); *F01L 1/18* (2013.01); *F01L 1/267* (2013.01); *F01L 1/34* (2013.01); *F01L 1/46* (2013.01); *F01L 1/2405* (2013.01); *F01L 1/2411* (2013.01); *F01L 1/2416* (2013.01); *F01L 13/0021* (2013.01); *F01L 13/0036* (2013.01); *F01L 2001/186* (2013.01); *F01L 2001/2433* (2013.01); *F01L 2001/2444* (2013.01); *F01L 2800/01* (2013.01); *F01L 2800/03* (2013.01)

(58) Field of Classification Search

CPC ... F01L 1/2405; F01L 1/2411; F01L 1/2416; F01L 2001/186; F01L 2001/2433; F01L 2001/2444; F01L 13/0021; F01L 13/0036

USPC ..... 123/90.15, 90.16, 90.2, 90.36, 90.44, 123/90.46

See application file for complete search history.

(56) References Cited

U.S. PATENT DOCUMENTS 4,829,948 A * 5/1989 Yoshida ..... F01L 1/26 123/90.16
5,207,193 A * 5/1993 Sugimoto ..... F01L 1/267 123/308

(Continued)

FOREIGN PATENT DOCUMENTS

JP 63-106306 A 5/1988
JP 2008-232078 A 10/2008

(Continued)

*Primary Examiner* — Jorge Leon, Jr.
(74) *Attorney, Agent, or Firm* — Kenyon & Kenyon LLP

(57) ABSTRACT

A control device of an internal combustion engine includes: a variable valve device including: first and second rocker arms; a cam; a rocker shaft provided with a lubricating oil passage; a pin switching the first and second rocker arms between a coupling state and a non-coupling state; a biasing member biasing the pin; a switching oil passage capable of supplying oil pressure to the pin in a direction opposite to a biasing direction; a lash adjuster; and a supplying oil passage, capable of supplying oil pressure to the pin in the biasing direction of the biasing member and supplying oil pressure into the lash adjuster, a hydraulic pump; an oil pressure control valve; and a control unit controlling the oil pressure control valve to always supply the supplying oil passage with oil pressure higher than oil pressure within the lubricating oil passage, during driving of an internal combustion engine.

4 Claims, 7 Drawing Sheets

(56) References Cited

U.S. PATENT DOCUMENTS

| | | | | |
|---|---|---|---|---|
| RE34,553 | E * | 3/1994 | Konno | F01L 1/2411 123/90.16 |
| 2006/0272598 | A1 * | 12/2006 | Wakeman | F01L 1/08 123/21 |
| 2008/0230023 | A1 | 9/2008 | Sugiura et al. | |

FOREIGN PATENT DOCUMENTS

| | | | |
|---|---|---|---|
| JP | 2009-264200 | A | 11/2009 |
| JP | 2009-287445 | A | 12/2009 |
| JP | 2010-275960 | A | 12/2010 |
| JP | 2011-058458 | A | 3/2011 |
| JP | 2013-142328 | A | 7/2013 |

* cited by examiner

CONTROL DEVICE OF INTERNAL COMBUSTION ENGINE AND VARIABLE VALVE DEVICE OF INTERNAL COMBUSTION ENGINE

CROSS-REFERENCE TO RELATED APPLICATION

This application is based upon and claims the benefit of priority of the prior Japanese Patent Application No. 2014-100531, filed on May 14, 2014, the entire contents of which are incorporated herein by reference.

FIELD OF THE INVENTION

The present invention relates to a control device of an internal combustion engine and a variable valve device of an internal combustion engine.

BACKGROUND

In some cases, a rocker shaft is provided therewithin with a lubricating oil passage for lubricating plural movable parts of an internal combustion engine, and this lubricating oil passage supplies oil pressure into a lash adjuster.

Also, in Japanese Laid-Open Patent Publication No. 2008-232078, the oil pressure is supplied into the lash adjuster through an oil passage exerting the oil pressure on a pin switching plural rocker arms between a coupling state and a non-coupling state. Related technologies are disclosed in Japanese Laid-Open Patent Publication Nos. 2009-264200 and 2010-275960.

For example, the oil pressure is supplied into the lash adjuster through a lubricating oil passage provided within a rocker shaft, which might cause a long period required for the oil pressure within the lubricating oil passage to increase and to reach a predetermined oil pressure, for example, in starting up the internal combustion engine, because of a comparatively low oil pressure within the lubricating oil passage. For this reason, the lash adjuster might not suitably act in starting up the internal combustion engine, which might cause a valve clearance to degrade noise and vibration.

Also, for example, as for the technology in Japanese Laid-Open Patent Publication No. 2008-232078, the plural rocker arms are switched between the coupling state and the non-coupling state by reducing the oil pressure exerting on the pin, which might also reduce the oil pressure within the lash adjuster. Accordingly, the lash adjuster might not suitably act, which might cause a valve clearance to degrade noise and vibration.

SUMMARY OF THE INVENTION

According to an aspect of the present invention, there is provided a control device of an internal combustion engine including: a variable valve device that includes: adjacent first and second rocker arms; a cam driving one of the first and second rocker arms; a rocker shaft supporting the first and second rocker arms and provided with a lubricating oil passage; a pin movable forward and backward between the first and second rocker arms and switching the first and second rocker arms between a coupling state and a non-coupling state; a biasing member biasing the pin toward the second rocker arm side; a switching oil passage provided in the second rocker arm and the rocker shaft and capable of supplying oil pressure to the pin in a direction opposite to a biasing direction of the biasing member; a lash adjuster provided in at least one of the first and second rocker arms; and a supplying oil passage provided in the first rocker arm and the rocker shaft, capable of supplying oil pressure to the pin in the biasing direction of the biasing member, and capable of supplying oil pressure into the lash adjuster, a hydraulic pump that is capable of supplying oil pressure to the lubricating oil passage, the switching oil passage, and the supplying oil passage; an oil pressure control valve that is capable of adjusting oil pressure within the switching oil passage and the supplying oil passage; and a control unit that controls the oil pressure control valve to always supply the supplying oil passage with oil pressure higher than oil pressure within the lubricating oil passage, during driving of an internal combustion engine.

During the driving of the internal combustion engine, the oil pressure is always supplied into the lash adjuster through the supply oil passage to which the oil pressure higher than the oil pressure within the lubricating oil passage is always supplied. This ensures supply of the oil pressure into the lash adjuster.

The control unit may prohibit an increase in oil pressure within the switching oil passage, until a period required to increase oil pressure within the lash adjuster elapses, after the internal combustion engine starts up after a predetermined period elapses from when the internal combustion engine stops.

According to another aspect of the present invention, there is provided a variable valve device of an internal combustion engine including: adjacent first and second rocker arms; a cam driving one of the first and second rocker arms; a rocker shaft supporting the first and second rocker arms and provided with a lubricating oil passage; a pin movable forward and backward between the first and second rocker arms and switching the first and second rocker arms between a coupling state and a non-coupling state; a biasing member biasing the pin toward the second rocker arm side; a switching oil passage provided in the second rocker arm and the rocker shaft and capable of supplying oil pressure to the pin in a direction opposite to a biasing direction of the biasing member; a lash adjuster provided in at least one of the first and second rocker arms; and a supplying oil passage provided in the first rocker arm and the rocker shaft, always supplying the pin with oil pressure higher than oil pressure within the lubricating oil passage in the biasing direction of the biasing member during driving of an internal combustion engine, and always supplying oil pressure into the lash adjuster.

During the driving of the internal combustion engine, the oil pressure is always supplied into the lash adjuster through the supply oil passage to which the oil pressure higher than the oil pressure within the lubricating oil passage is always supplied. This ensures supply of the oil pressure into the lash adjuster.

An increase in oil pressure within the switching oil passage may be prohibited, until a period required to increase oil pressure within the lash adjuster elapses, after the internal combustion engine starts up after a predetermined period elapses from when the internal combustion engine stops.

DETAILED DESCRIPTION

Figure 1:
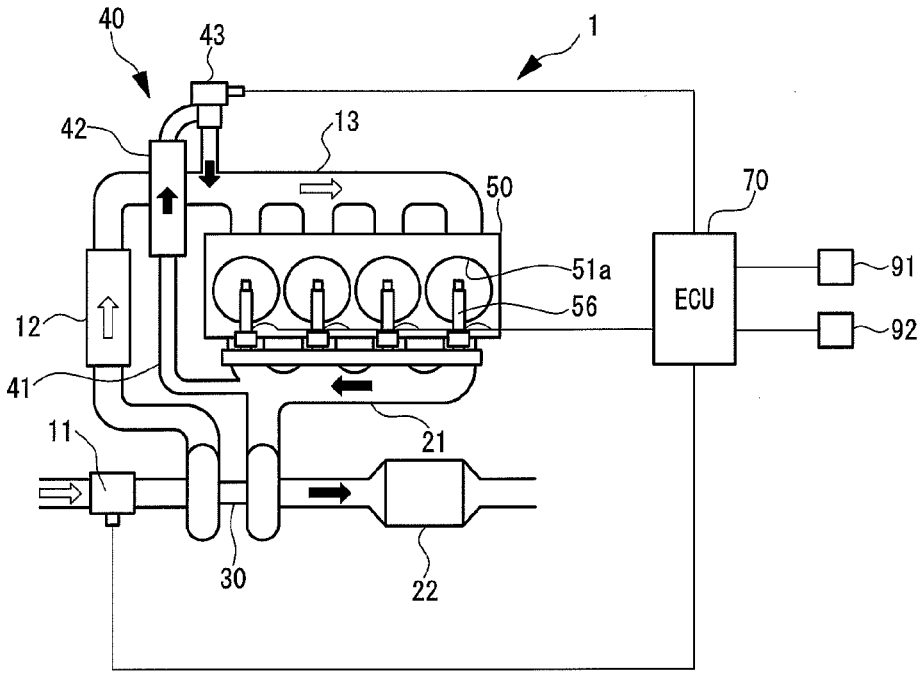
FIG. 1 is an explanatory view of an engine system.

FIG. 1 is an explanatory view of an engine system 1 according to the embodiment. The engine system 1 includes: an engine 50 as an internal combustion engine; an intake passage 13 and an exhaust passage 21 coupled to the engine 50. The engine 50 is a four-cylinder engine including four cylinders 51*a*, and includes four fuel injection valves 56 respectively injecting directly fuel to the four cylinders 51*a*. However, the number of the cylinders in the engine may not be limited to this, and the engine may be a gasoline engine, a diesel engine, or another engine.

The intake passage 13 is provided with: an airflow meter 11 for detecting the intake air amount; a compressor of a turbocharger 30; and an intercooler 12 for cooling intake air. The exhaust passage 21 is provided with: an exhaust turbine of the turbocharger 30; and a catalyst 22 for purifying the exhaust gas. An EGR (Exhaust Gas Recirculation) passage 41 is provided between the intake passage 13 and the exhaust passage 21. The EGR passage 41 is provided with an EGR cooler 42 and an EGR valve 43.

An ECU 70 entirely controls the engine system 1. The ECU 70 is a computer including a ROM (Read Only Memory), a RAM (Random Access Memory), and a CPU (Central Processing Unit) not illustrated. The ECU 70 is electrically coupled with: the airflow meter 11; the EGR valve 43; a crank angle sensor 91 for detecting a crank angle θ; and an accelerator opening degree sensor 92 for requesting the engine 50 to accelerate. The ECU 70 is an example of a control unit.

Figure 2:
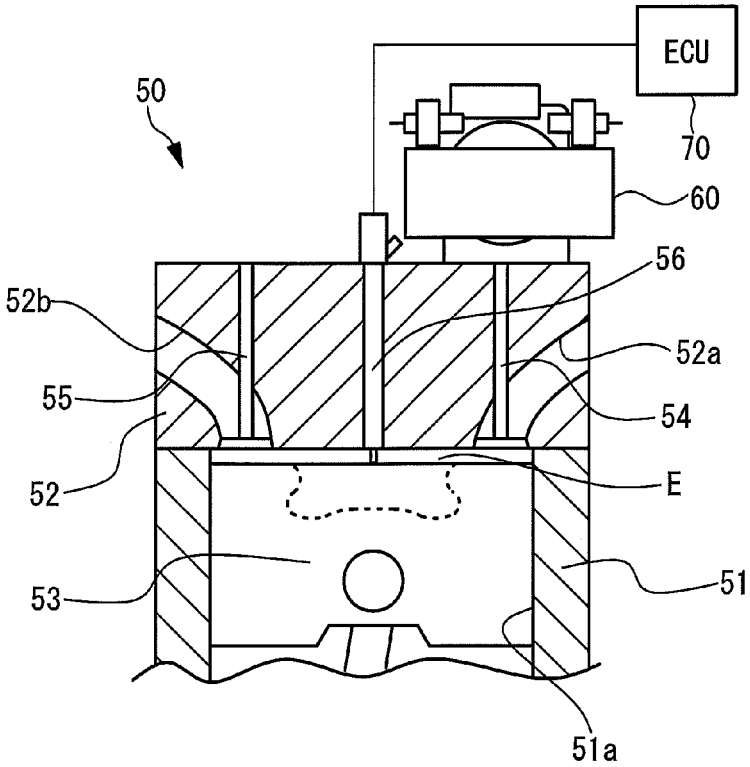
FIG. 2 is an explanatory view of an engine.

FIG. 2 is an explanatory view of the engine 50. The engine 50 includes a cylinder block 51, a cylinder head 52, a piston 53, an intake valve 54, an exhaust valve 55, a fuel injection valve 56, and a variable valve device 60. The cylinder block 51 is provided with the cylinder 51*a*. Every cylinder 51*a* is provided with the piston 53, the intake valve 54, the exhaust valve 55, and the fuel injection valve 56. The piston 53 is accommodated in the cylinder 51*a*. The cylinder head 52 is secured on a top surface of the cylinder block 51. A combustion chamber E is defined as a space enclosed by the cylinder block 51, the cylinder head 52, and the piston 53.

The cylinder head 52 includes: an intake port 52*a* introducing intake air into the combustion chamber E opened and closed by the intake valve 54; and an exhaust port 52*b* exhausting exhaust gas from the combustion chamber E opened and closed by the exhaust valve 55. Note that, the single cylinder 51*a* in the embodiment is provided with two intake ports 52*a* and two exhaust ports 52*b*, and similarly with two intake valves 54 and two exhaust valves 55. The fuel injection valve 56, provided in the cylinder head 52, injects fuel to the combustion chamber E.

Figure 3:
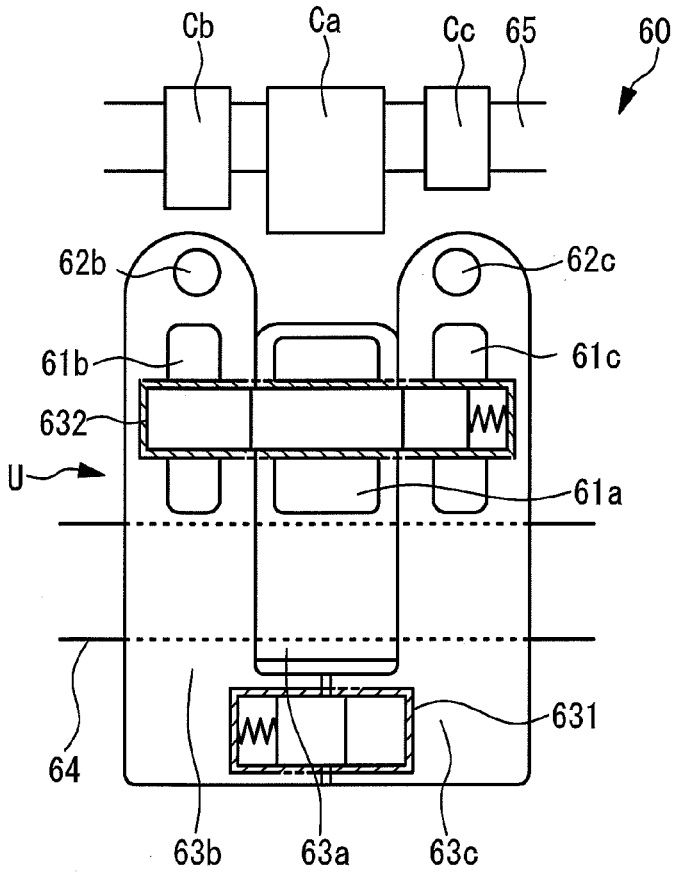
FIG. 3 is an explanatory view of a variable valve device.

FIG. 3 is an explanatory view of the variable valve device 60. The variable valve device 60 is provided in the cylinder head 52. The variable valve device 60 includes: an intake camshaft 65 secured to cams Ca to Cc; a rocker shaft 64 secured to the cylinder head 52; and rocker arms 63*a* to 63*c* swingably supported by the rocker shaft 64. The rocker arms 63*a* to 63*c* form a unit U. The unit U is provided in every cylinder 51*a*. Likewise, the three cams Ca to Cc, provided in every cylinder 51*a*, are used for driving the intake valves 54 provided in every cylinder 51*a*. The rocker arms 63*a* to 63*c* are provided with rollers 61*a* to 61 *c* with which the cams Ca to Cc can come into contact, respectively. The rollers 61*a* to 61*c* are rotatably supported by the rocker shaft 64. The rocker arms 63*a* to 63*c* can swing separately from one another. The camshaft 65 is parallel with the rocker shaft 64. The cams Cb, Ca, and Cc are axially arranged in this order. Likewise, the rocker arms 63*b*, 63*a*, and 63*c* are axially arranged in this order. Accordingly, the rocker arm 63*a* is sandwiched between the rocker arms 63*b* and 63*c*.

The rocker arms 63*b* and 63*c* respectively drive the intake valves 54, but the rocker arm 63*a* does not come into contact with the intake valve 54. Front end portions of the rocker arms 63*b* and 63*c* are respectively provided with lash adjusters 62*b* and 62*c*. The lash adjusters 62*b* and 62*c* maintain zero clearance between the lash adjusters 62*b* and 62*c* and the intake valves 54, and are in contact with upper ends of stems of the two intake valves 54, respectively. The rocker arms 63*b* and 63*c* are in contact with each other at their rear ends. The rocker arms 63*b* and 63*c* are an example of first and second rocker arms, respectively.

The rocker arms 63*b* and 63*c* are provided with a coupling mechanism 631 for switching the rocker arms 63*b* and 63*c* between a coupling state and a non-coupling state. The coupling mechanism 631 is provided at a portion where the rocker arms 63*b* and 63*c* are in contact with each other. In the coupling state, the rocker arms 63*b* and 63*c* integrally swing. Further, the rocker arms 63*a* to 63*c* are, provided with a coupling mechanism 632 for switching the rocker arms 63*a* to 63*c* between the coupling state and the non-coupling state. In the coupling state, the rocker arms 63*a* to 63*c* integrally swing. Both coupling mechanisms 631 and 632 are hydraulic types. These will be described later in detail.

Figure 4:
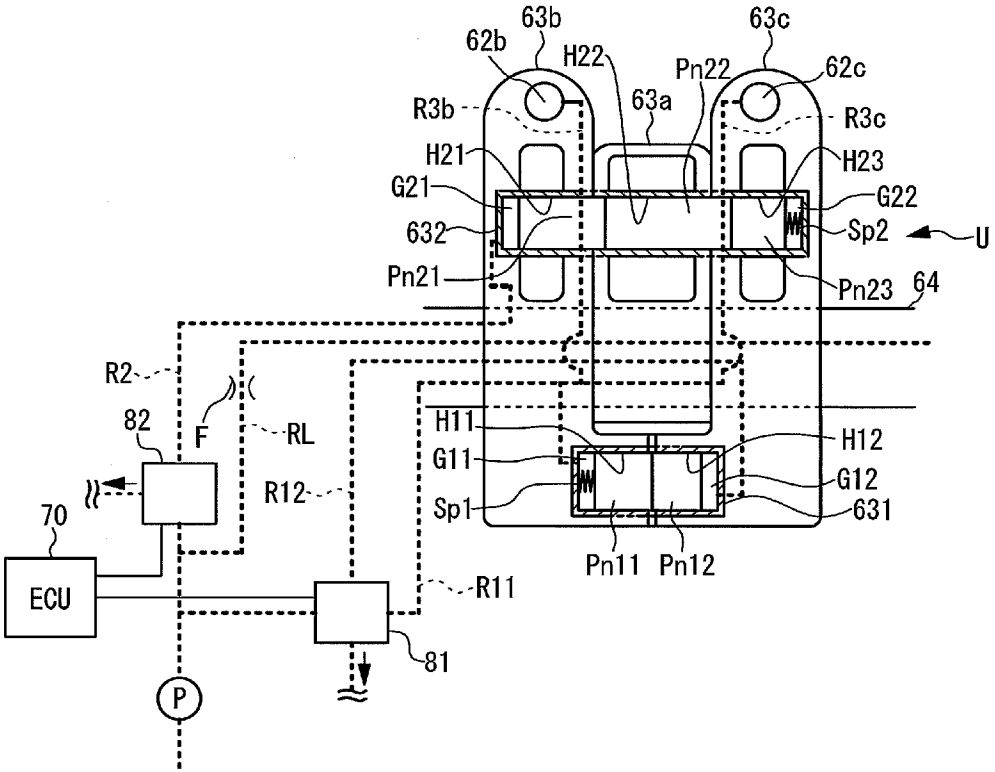
FIG. 4 is an explanatory view of coupling mechanisms and oil passages.

FIG. 4 is an explanatory view of the coupling mechanisms 631 and 632 and oil passages. The coupling mechanism 631 includes holes H11 and H12, pins Pn11 and Pn12, and a spring Sp1. The holes H11 and H12 are respectively provided in the rocker arms 63*b* and 63*c* in axial alignment with each other in the state where the rocker arms 63*b* and 63*c* do not swing, each has a cylindrical shape with a bottom, and have the same inner diameter.

The pin Pn11, slidably held within the holes H11 and H12, is movable forward and backward between the rocker arms 63*b* and 63*c*. The pin Pn12 is slidably held within the hole H12. The pins Pn11 and Pn12 each has a column shape, and have the same outer diameter.

A spring chamber G11 is provided between a bottom portion of the hole H11 and the pin Pn11. The spring Sp1, provided in the spring chamber G11, biases the pin Pn11 toward the rocker arm 63*c* side. A hydraulic chamber G12 is provided between a bottom portion of the hole H12 and the pin Pn12.

Figure 5:
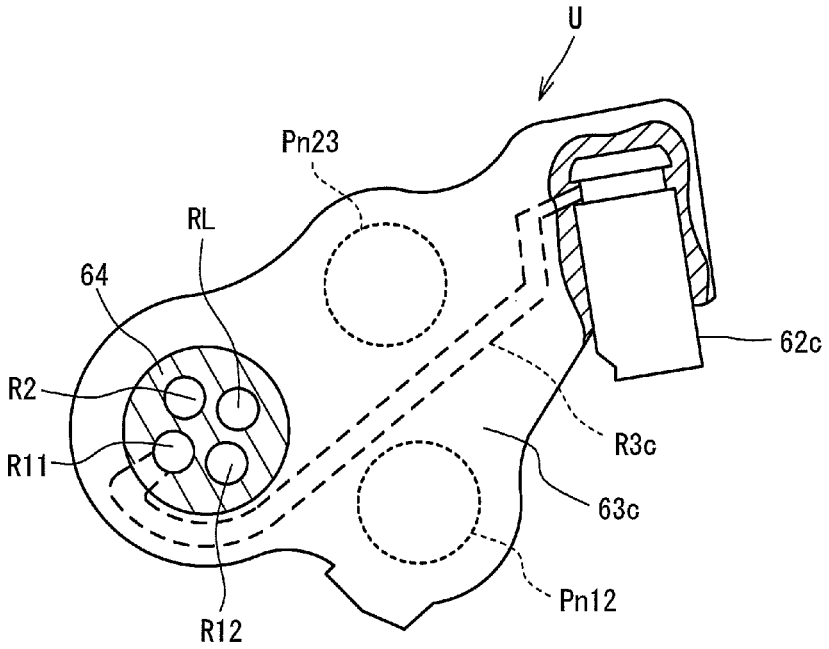
FIG. 5 is a partially sectional view of a side surface of a unit.

An oil passage R11 communicates with the spring chamber G11 through the rocker shaft 64 and the rocker arm 63*b*. An oil passage R12 communicates with the hydraulic chamber G12 through the rocker shaft 64 and the rocker arm 63*c*. The oil passage R11 communicates with oil passages R3*b* and R3*c* respectively provided in the rocker arms 63*b* and 63*c*. FIG. 5 is a partially sectional view of a side surface of the unit U. The oil passage R11 communicates with the oil passage R3*c*, and the oil passage R3*c* communicates with the rocker arm 63*c*. The oil passages R3*b* and R3*c* will be described later.

The oil passages R11 and R12 communicate with a main gallery provided in the engine 50 side. The oil passages R11 and R12 are provided with an OCV (Oil Control Valve) 81, which controls oil pressure within the oil passages R11 and R12 in accordance with instructions from the ECU 70. During the driving of the engine 50, the ECU 70 controls the OCV 81 to always supply the oil pressure to the oil passage R11 so as to supply constant oil pressure into the spring chamber G11. The oil pressure supplied into the spring chamber G11 exerts on the pin Pn11 in the same direction as the biasing direction of the spring Sp1. Also, the ECU 70 controls the OCV 81 to supply the oil pressure into the hydraulic chamber G12, when a predetermined condition is satisfied. The oil pressure supplied into the hydraulic chamber G12 exerts on the pin Pn11 in the direction opposite to the biasing direction of the spring Sp1. The OCV 81 is an example of an oil pressure control valve. The spring Sp1 is an example of a biasing member.

In the state where the oil pressure is not supplied into the hydraulic chamber G12, the biasing force of the spring Sp1 and the oil pressure supplied into the spring chamber G11 bias the pin Pn11 toward the rocker arm 63*c* side to push the pin Pn12, so that the pin Pn12 is pushed against the bottom portion of the hole H12. In this state, the pin Pn12 is held in the hole H12, but the pin Pn11 engages with both holes H11 and H12. Thus, the rocker arms 63*b* and 63*c* are coupled and restricted from separately swinging.

When the OCV 81 is controlled to supply the oil pressure into the hydraulic chamber G12 through the oil passage R12, the pins Pn11 and Pn12 are moved toward the rocker arm 63*b* side against the oil pressure within the spring chamber G11 and against the biasing force of the spring Sp1. Thus, the pin Pn11 disengages from the hole H12. Accordingly, the pins Pn11 and Pn12 are respectively held in the holes H11 and H12, and the coupling of the rocker arms 63*b* and 63*c* is released to allow separate swing thereof. The oil passage R12 is an example of the switching oil passage.

When the OCV 81 is controlled to stop supplying the oil pressure into the hydraulic chamber G12, the oil pressure within the hydraulic chamber G12 decreases. Thus, the pins Pn11 and Pn12 are pushed toward the rocker arm 63*c* side in accordance with the oil pressure within the spring chamber G11 and with the biasing force of the spring Sp1, so that the pin Pn11 engages with both holes H11 and H12. In such a way, the rocker arms 63*b* and 63*c* are coupled again. Thus, when the coupling state is switched from the non-coupling state, the pins Pn11 and Pn12 are moved with the aid of not only the biasing force of spring Sp1 but also the oil pressure within the spring chamber G11. This suppresses deterioration in responsiveness to switching the rocker arms 63*b* and 63*c* from the non-coupling state to the coupling state.

The coupling mechanism 632 includes holes H21 to H23, pins Pn21 to Pn23, and a spring Sp2. The holes H21 to H23 are respectively provided in the rocker arms 63*b*, 63*a*, and 63*c* in axial alignment with one another in the state where the rocker arms 63*a* to 63*c* do not swing, and have the same inner diameter. The holes H21 and H23 each have a cylindrical shape with a bottom. The hole H22 has a cylindrical shape penetrating through the rocker arm 63*a*.

The pin Pn21 is slidably held within the holes H21 and H22. The pin Pn22 is slidably held within the holes H22 and H23. The pin Pn23 is slidably held within the hole H23. The pins Pn21, Pn22, and Pn23 each have a column shape and the same outer diameter.

A hydraulic chamber G21 is provided between a bottom portion of the hole H21 and the pin Pn21. A spring chamber G22 is provided between a bottom portion of the hole H23 and the pin Pn23. The spring Sp2, provided in the spring chamber G22, biases the pin Pn23 toward the rocker arm 63*a* side.

The oil passage R2 communicates with the hydraulic chamber G21 through the rocker shaft 64 and the rocker arm 63*b*. Also, the oil passage R2 communicates with the main gallery mentioned above. On the oil passage R2 is provided an OCV 82. The OCV 82 controls the oil pressure within the oil passage R2 in accordance with instructions from the ECU 70. The ECU 70 controls the OCV 82 to supply the oil pressure into the hydraulic chamber G21, specifically, when a predetermined condition is satisfied. The oil pressure supplied into the hydraulic chamber G21 exerts on the pin Pn21 in the direction opposite to the biasing direction of the spring Sp2.

In the state where the oil pressure is not supplied into the hydraulic chamber G21, the pins Pn21 to Pn23 are restricted from moving against the biasing force of the spring Sp2, and are respectively held in the holes H21 to H23. Accordingly, the rocker arms 63*a* to 63*c* are brought into the non-coupling state allowing separate swing thereof.

When the OCV 82 is controlled to supply the oil pressure into the hydraulic chamber G21, the pins Pn21 to Pn23 moves toward the rocker arm 63*c* side against the biasing force of the spring Sp2. Thus, the pin Pn21 engages with the holes H21 and H22, and the pin Pn22 engages with the holes H22 and H23. Accordingly, the pin Pn21 connects the rocker arms 63*b* and 63*a*, and the pin Pn22 connects the rocker arms 63*a* and 63*c*. Thus, the rocker arms 63*a* to 63*c* are coupled and restricted from separately swinging.

When the OCV 82 is controlled to stop supplying the oil pressure to the hydraulic chamber G21 and the oil pressure decreases, the pins Pn21 to Pn23 move toward the rocker arm 63*b* side in accordance with the biasing force of the spring Sp2. The Pins Pn21 and Pn23 are respectively held in the holes H21 to H23, so that the rocker arms 63*a* to 63*c* are brought into the non-coupling state again.

An oil passage RL passes through the rocker shaft 64 and supplies oil to each movable portion of the engine 50 for lubrication. The oil passage RL communicates with an oil passage provided in the cylinder head 52. The oil flowing in the oil passage RL is supplied to, for example, a cam shower pipe or the like in use for lubrication between the camshaft and the cylinder head. The flow rate of the oil flowing in the oil passage RL is reduced by an orifice F. This is because the oil flowing in the oil passage RL for purposes of lubrication does not need a large flow rate. Thus, the oil pressure within the oil passage RL is lower than that within the oil passage R11, lower than that within the oil passage R12 in switching the rocker arms 63*b* and 63*c* to the non-coupling state, and lower than that within the oil passage R2 in switching the rocker arms 63*a* to 63*c* to the coupling state. In addition, oil is supplied to the oil passages R11, R12, R2, and RL by a hydraulic pump P. The hydraulic pump P is a mechanical type using the engine 50 as a drive source, but may be an electrical type.

Figure 6A:
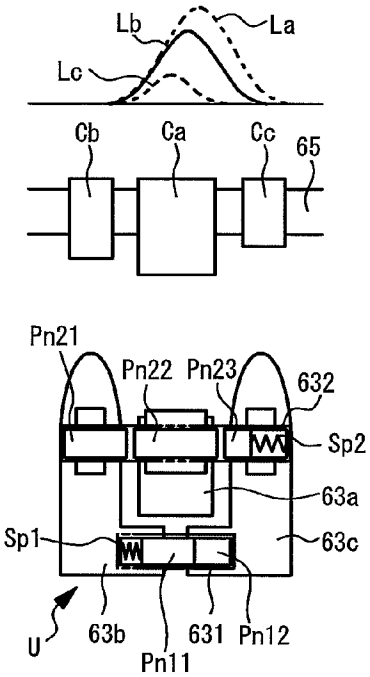
FIGS. 6A to 6C are explanatory views of cam switching.
Figure 6B:
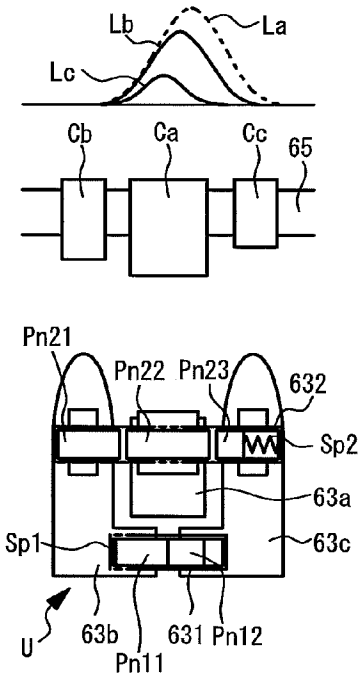
Figure 6C:
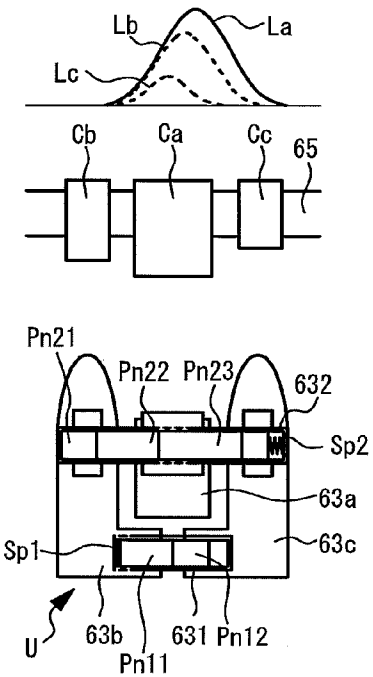

FIGS. 6A to 6C are explanatory views of the cam switching. FIGS. 6A to 6C respectively illustrate cases of using the cam Cb, the cams Cb and Cc, and the cam Ca. FIGS. 6A to 6C illustrate the unit U, the camshaft 65, and lift curves La, Lb, and Lc.

The cams Ca to Cc have cam profiles different from one another. As indicated by the lift curves La to Lc, the lift amount of the intake valve 54 by the cam Ca is the largest, and the lift amount of the intake valve 54 by the cam Cc is smallest. Also, an operation angle of the intake valve 54 by the cam Ca is largest, and an operation angle of the intake valve 54 by the cam Cc is smallest. As illustrated in FIGS. 6A to 6C, the lift curve Lb is enclosed in the lift curve La, and the lift curve Lc is enclosed in the lift curve Lb.

In FIG. 6A, the coupling mechanism 631 brings the rocker arms 63*b* and 63*c* into the coupling state, and the coupling mechanism 632 brings the rocker arms 63*a* to 63*c* into the non-coupling state. In this case, the rocker arms 63*b* and 63*c* integrally swing, but the rocker arm 63*a* swings separately therefrom. Herein, although the rocker arms 63*b* and 63*c* respectively correspond to the cams Cb and Cc, the operation angle and the lift amount of the intake valve 54 by the cam Cb are respectively larger than the operation angle and the lift amount of the intake valve 54 by the cam Cc, as mentioned above. For this reason, the cam Cb allows the rocker arms 63*b* and 63*c* to swing, so the two intake valves 54 lift as indicated by the lift curve Lb.

Also, in FIG. 6B, the coupling mechanism 631 brings the rocker arms 63*b* and 63*c* into the non-coupling state, and the coupling mechanism 632 brings the rocker arms 63*a* to 63*c* into the non-coupling state. In this case, all of the rocker arms 63*a* to 63*c* swing separately therefrom. For this reason, the cams Cb and Cc respectively allow the rocker alms 63*b* and 63*c* to swing. Thus, the intake valve 54 driven by the rocker arm 63*b* lifts as indicated by the lift curve Lb, and the intake valve 54 driven by the rocker arm 63*c* lifts as indicated by the lift curve Lc.

In FIG. 6C, the coupling mechanism 631 brings the rocker arms 63*b* and 63*c* into the non-coupling state, and the coupling mechanism 632 brings the rocker arms 63*a* to 63*c* into the coupling state. In this case, since the operation angle and the lift amount of the intake valve 54 by the cam Ca are largest, the cam Ca allows the rocker arms 63*a* to 63*c* to integrally swing. Thus, the two intake valves 54 respectively driven by the rocker arms 63*b* and 63*c* lift, as indicated by the lift curve La.

As described heretofore, the cam lifting the intake valve 54 is switched by controlling the oil pressure exerting on the pins Pn11, Pn12, and Pn21 to Pn23.

As illustrated in FIGS. 4 and 5, the oil passages R3*b* and R3*c* communicating with the oil passage R11 respectively communicate with the lash adjusters 62*b* and 62*c*. As mentioned above, the oil pressure is always supplied to the oil passage R11 communicating with the spring chamber G11 during the driving of the engine 50. Accordingly, the oil pressure is always supplied into the lash adjusters 62*b* and 62*c* through the oil passages R3*b* and R3*c* communicating with the oil passage R11. Thus, followability of the lash adjusters 62*b* and 62*c* against the rocker arms 63*b* and 63*c* is ensured to maintain zero valve-clearance, restricting increases in noise and vibration. The oil passages R11, R3*b*, and R3*c* are an example of a supply oil passage.

For example, it is considered that the oil pressure is supplied into the lash adjusters 62*b* and 62*c* through the oil passage RL. Herein, the oil flowing in the oil passage RL is transported to each movable portion of the engine 50 for lubrication, so the oil pressure within the oil passage RL is comparatively low. In contrast, the lash adjusters 62*b* and 62*c* need comparatively large oil pressure to follow the rocker arms 63*b* and 63*c* reciprocating for a short period. For this reason, in a case where the oil pressure is supplied into the lash adjusters 62*b* and 62*c* through the oil passage RL, for example, a long period might be required for the oil pressure within the lash adjusters 62*b* and 62*c* to reach a predetermined oil pressure when the engine 50 starts up. For this reason, the performance of the lash adjusters 62*b* and 62*c* might deteriorate, which might cause a valve clearance to degrade noise and vibration.

In this case, for example, in order to increase a flow velocity of the oil within the oil passage RL, it is considered that a large hydraulic pump is employed. In this case, however, the whole engine system 1 might increase in size. Also, in a case of the mechanical type of the hydraulic pump, since the hydraulic pump drives based on the driving force from the engine 50, the load on the engine 50 might increase to degrade fuel consumption. Even in the case of the electric type of the hydraulic pump, an increase in power consumption of the hydraulic pump might increase the required amount of power generation based on the driving of the engine 50, which might degrade fuel consumption.

In the embodiment, during the driving of the engine 50, the oil pressure higher than the oil pressure within the oil passage RL is always supplied into the lash adjusters 62*b* and 62*c* from the oil passage R11. Thus, the oil pressure within the lash adjusters 62*b* and 62*c* can increase immediately to suppress increases in noise and vibration, the increase in the whole size of the engine system 1 can be also suppressed, and so the deterioration in fuel consumption can be suppressed.

Further, as described above, the oil passage R11 exerts the oil pressure on the pin Pn11 in the same direction as the biasing direction of the spring Sp1, thereby suppressing the deterioration in responsiveness of switching the rocker arms 63*b* and 63*c* from the non-coupling state to the coupling state. In the embodiment, the oil passage R11, which is provided for suppressing deterioration in responsiveness of switching and to which the oil pressure is always supplied during the driving of the engine 50, communicates with the oil passages R3*b* and R3*c* to supply the oil pressure into the lash adjusters 62*b* and 62*c*. Thus, as compared with a case where an oil passage is provided separately from the oil passage R11 within the rocker shaft 64 and the rocker arms 63*b* and 63*c* to supply the oil pressure into the lash adjusters 62*b* and 62*c*, the structure of the oil passage within the rocker shaft 64 is simple.

It is also considered that the oil pressure is supplied into the lash adjusters 62*b* and 62*c*, for example, through the oil passage pressure for switching between the coupling state and the non-coupling state by use of the pin by reducing the oil pressure. In this case, the decrease in the oil pressure within the oil passage might decrease the oil pressure within the lash adjusters 62*b* and 62*c*, which might cause the valve clearance to increase noise and vibration. In the embodiment, the oil pressure is supplied into the lash adjusters 62*b* and 62*c* from the oil passage R11 to which the oil pressure is always supplied during the driving of the engine 50. Accordingly, such above problems can be suppressed.

Figure 7:
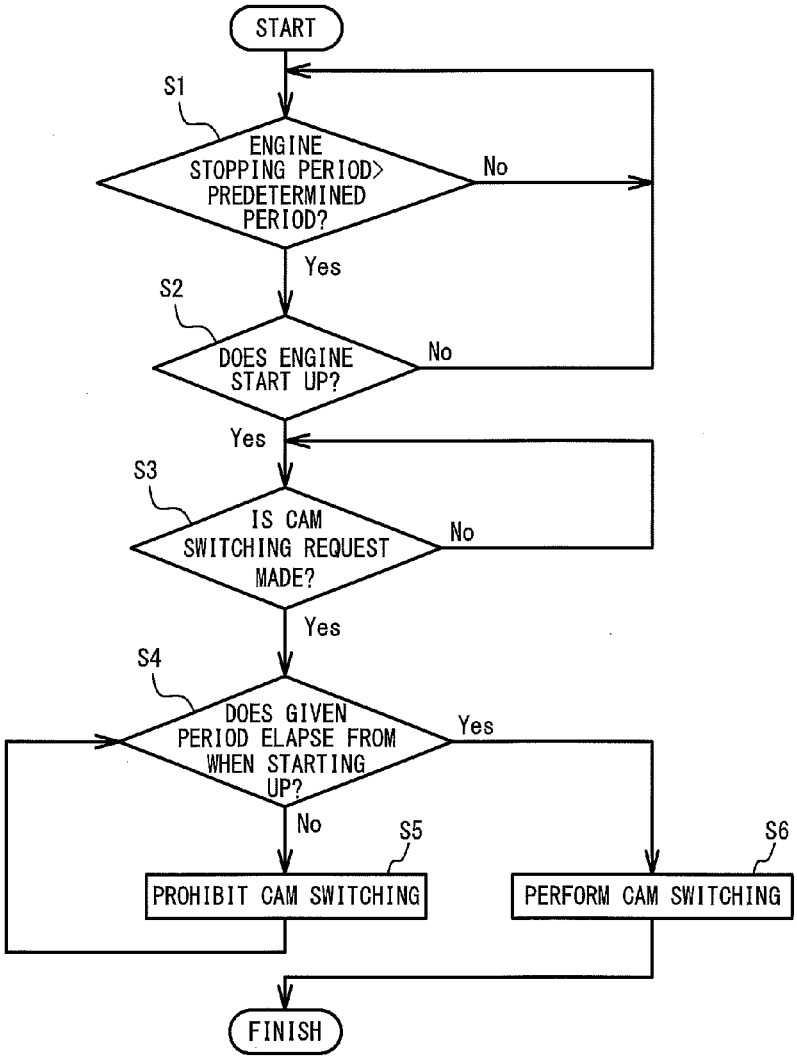
FIG. 7 is a flowchart of an example of cam switching prohibition control.

Next, a description will be given of cam switching prohibition control performed by the ECU 70. FIG. 7 is a flowchart of an example of the cam switching prohibition control. As illustrated in FIG. 7, the ECU 70 determines whether or not a stopping period of the engine 50 exceeds a predetermined period (step S1). For example, on the basis of a value counted up from when an ignition switch is turned off and the engine 50 stops, the ECU 70 makes the above determination. A predetermined period means a period from when the engine 50 stops to when the oil pressure within the lash adjusters 62*b* and 62*c* has greatly decreased. This is because the engine 50 stops and the hydraulic pump P also stops not to newly supply the oil into the lash adjusters 62*b* and 62*c* and to leak the oil out of the lash adjusters 62*b* and 62*c* with time. A predetermined period means, for example, a period from when the engine 50 stops to when the oil pressure within the lash adjusters 62*b* and 62*c* reaches substantially zero. If a negative determination is made in step S1, the ECU 70 performs the processing of step S1 again.

If an affirmative determination is made in step S1, the ECU 70 determines whether or not the engine 50 starts up (step S2). For example, on the basis of output signals from the ignition switch, the ECU 70 makes the above determination. If a negative determination is made, the ECU 70 performs the processing of step S1 again.

If an affirmative determination is made in step S2, the ECU 70 determines whether or not a cam switching request is made (step S3). The cam switching request is requested depending on the driving state of the engine 50, specifically, the engine rotational speed and load. Note that, when the engine 50 starts up, the intake valve 54 is driven by the cam Cb as illustrated in FIG. 6A. If a negative determination is made, the ECU 70 performs the processing of step S3 again.

If an affirmative determination is made in step S3, the ECU 70 determines whether or not a given period elapses from when the engine 50 starts up (step S4). For example, on the basis of a value counted up from when the engine 50 starts up, the ECU 70 makes the above determination. If a negative determination is made, the ECU 70 prohibits the cam switching (step S5) and performs the processing of step S4 again. If an affirmative determination is made, the ECU 70 performs the cam switching (step S6). That is, the ECU 70 prohibits the cam switching until a given period elapses from when the engine 50 starts up, even if the cam switching request is made.

A given period means a period which is required to increase the oil pressure within the lush adjusters 62*b* and 62*c* after the engine 50 starts up from when the engine 50 stops over a predetermined period. That is, the cam switching is prohibited from when the engine 50 starts up to when the oil pressure within the lash adjusters 62*b* and 62*c* increases. If the cam switching is performed in this period, since the cam switching is performed by use of the oil as described above, a long period might be required to increase the oil pressure within the lash adjusters 62*b* and 62*c*. Thus, the lash adjusters 62*b* and 62*c* might not suitably act in starting up the engine 50, which might degrade noise and vibration.

In the embodiment, the cam switching is prohibited without supplying the oil pressure to the hydraulic chambers G12 and G21 during a given period from when the engine 50 starts up, which preferentially increases the oil pressure within the lash adjusters 62*b* and 62*c*. Thus, the oil pressure within the lash adjusters 62*b* and 62*c* can increase immediately to suppress increases in noise and vibration when the engine 50 starts up.

In addition, the ECU 70 may determine, for example, whether or not the oil pressure in the main gallery is equal to or less than a predetermined value, instead of the processing of step S1. In this case, if the oil pressure in the main gallery is equal to or less than a predetermined value, it may be determined the stopping period of the engine 50 exceeds a predetermined period. The oil pressure in the main gallery is determined by the ECU 70 on the basis of output values from an oil pressure sensor provided in the main gallery.

Also, the ECU 70 may determine, for example, whether or not an idle driving state of the engine 50 is stable based on the engine rotational speed, instead of the processing of step S4. In this case, if the idle driving state is not stable, the cam switching is prohibited, and if it is stable, the cam switching is performed. This is because the oil pressure within the lash adjusters 62*b* and 62*c* has already reached a desired oil pressure if the idle driving state is stable.

Also, for example, a period from when the engine 50 starts up to when the oil pressure within the lash adjusters 62*b* and 62*c* increases may be calculated from experiments beforehand, and this period may be used as a given period in step S4.

Although some embodiments of the present invention have been described in detail, the present invention is not limited to the specific embodiments but may be varied or changed within the scope of the present invention as claimed.

In the embodiment, the three rocker arms 63*a* to 63*c* and the three cams Ca to Cc are provided for the single cylinder 51*a*, but they are not limited to this. For example, the rocker arm 63*a*, the cam Ca, and the coupling mechanism 632 may not be provided. That is, the two rocker arms 63*b* and 63*c* may be respectively driven by the two cams Cb and Cc having the different cam profiles. In this case, in the coupling state of the rocker arms 63*b* and 63*c*, the two intake valves 54 lift, as indicated by the lift curve Lb illustrated in FIG. 6A. In the non-coupling state, the intake valve 54 lifts as indicated by the lift curve Lb, and the other intake valve 54 lifts as indicated by the lift curve Lc illustrated in FIG. 6B. Further, only one of the two rocker arms 63*b* and 63*c* may be driven by a single cam. In this case, in the coupling state of the rocker arms 63*b* and 63*c*, the two intake valves 54 are driven by the single cam through the rocker arms 63*b* and 63*c*. In contrast, in the non-coupling state, one of the rocker arms 63*b* and 63*c* is driven by the cam, the other one is maintained in a stopped state, which drives only one of the two intake valves 54.

The above described variable valve device 60 may be provided in the exhaust valve 55 side, or the intake valve 54 side and the exhaust valve 55 side.

The oil pressure is supplied to the two lash adjusters 62*b* and 62*c* through the oil passages R11, R3*b*, and R3*c*, but is not limited to these. For example, an oil passage may be provided to communicate with the oil passage R11 and any one of the lash adjusters 62*b* and 62*c*, the oil pressure may be supplied from the oil passage R11 to one of the lash adjusters 62*b* and 62*c*, and the oil pressure may be supplied to the other one through the oil passage RL.

The lash adjuster may be secured to the cylinder head and may support the rear end side of the rocker arm opposite to the front end thereof contacting with the valve.

What is claimed is:

1. A control device of an internal combustion engine comprising:

a variable valve device that includes:

adjacent first and second rocker arms;

a cam driving one of the first and second rocker arms;

a rocker shaft supporting the first and second rocker arms and provided with a lubricating oil passage;

a pin moving forward and backward between the first and second rocker arms and switching the first and second rocker arms between a coupling state and a non-coupling state;

a biasing member biasing the pin toward the second rocker arm side;

a switching oil passage provided in the second rocker arm and the rocker shaft and supplies oil pressure to the pin in a direction opposite to a biasing direction of the biasing member;

a lash adjuster provided in at least one of the first and second rocker arms; and a supplying oil passage provided in the first rocker arm and the rocker shaft, supplies oil pressure to the pin in the biasing direction of the biasing member, and supplies oil pressure into the lash adjuster, a hydraulic pump that supplies oil pressure to the lubricating oil passage, the switching oil passage, and the supplying oil passage;

an oil pressure control valve that adjusts oil pressure within the switching oil passage and the supplying oil passage; and a control unit that controls the oil pressure control valve to always supply the supplying oil passage with oil pressure higher than oil pressure within the lubricating oil passage, during driving of the internal combustion engine.

2. The control device of the internal combustion engine of claim 1, wherein the control unit prohibits an increase in oil pressure within the switching oil passage, until a period required to increase oil pressure within the lush adjuster elapses, after the internal combustion engine starts up after a predetermined period elapses from when the internal combustion engine stops.

3. A variable valve device of an internal combustion engine comprising:

adjacent first and second rocker arms;

a cam driving one of the first and second rocker arms;

a rocker shaft supporting the first and second rocker arms and provided with a lubricating oil passage;

a pin moving forward and backward between the first and second rocker arms and switching the first and second rocker arms between a coupling state and a non-coupling state;

a biasing member biasing the pin toward the second rocker arm side;

a switching oil passage provided in the second rocker arm and the rocker shaft and supplies oil pressure to the pin in a direction opposite to a biasing direction of the biasing member;

a lash adjuster provided in at least one of the first and second rocker arms; and a supplying oil passage provided in the first rocker arm and the rocker shaft, always supplying the pin with oil pressure higher than oil pressure within the lubricating oil passage in the biasing direction of the biasing member during driving of an internal combustion engine, and always supplying oil pressure into the lash adjuster.

4. The variable valve device of the internal combustion engine of claim 3, wherein an increase in oil pressure within the switching oil passage is prohibited, until a period required to increase oil pressure within the lush adjuster elapses, after the internal combustion engine starts up after a predetermined period elapses from when the internal combustion engine stops.

* * * * *